United States Patent [19]

Yamazaki et al.

[11] Patent Number: 5,027,745

[45] Date of Patent: Jul. 2, 1991

[54] DEVELOPING APPARATUS HAVING DEVELOPER CARRYING ROLLER WITH CARBON FIBERS IN SURFACE LAYER

[75] Inventors: Michihito Yamazaki, Tokyo; Katsuhiko Nishimura, Yokohama; Keiji Okano, Yokohama; Kouichi Suwa, Yokohama; Yasuhi Sato; Kimio Nakahata, both of Kawasaki, all of Japan

[73] Assignee: Canon Kabushiki Kaisha, Tokyo, Japan

[21] Appl. No.: 421,656

[22] Filed: Oct. 16, 1989

[30] Foreign Application Priority Data

Oct. 18, 1988 [JP] Japan ..... 63-263697
Oct. 18, 1988 [JP] Japan ..... 63-263699

[51] Int. Cl.[5] ..... G03G 15/09

[52] U.S. Cl. ..... 118/658; 118/653; 355/251; 355/259

[58] Field of Search ..... 355/251, 253, 259; 118/657, 658, 653

[56] References Cited

U.S. PATENT DOCUMENTS

| | | | |
|---|---|---|---|
| 4,037,709 | 7/1977 | Fraser | 118/658 |
| 4,368,971 | 1/1983 | Watanabe et al. | 355/253 |
| 4,380,966 | 4/1983 | Isaka et al. | 118/651 |
| 4,385,829 | 5/1983 | Nakahata et al. | 355/253 |
| 4,557,582 | 12/1985 | Kan et al. | 118/658 |
| 4,579,082 | 4/1986 | Murasawa et al. | 118/658 |
| 4,669,852 | 6/1987 | Tajima et al. | 355/253 |

FOREIGN PATENT DOCUMENTS

| | | |
|---|---|---|
| 61-23171 | 1/1986 | Japan . |
| 61-69083 | 4/1986 | Japan . |
| 62-95563 | 5/1987 | Japan . |

*Primary Examiner*—Joan H. Pendegrass
*Attorney, Agent, or Firm*—Fitzpatrick, Cella, Harper & Scinto

[57] ABSTRACT

A developing apparatus including a developing roller for carrying an one component developer to a developing zone for developing an electrostatic latent image. The developing roller is provided with a surface layer which contains long carbon fibers extending substantially parallel to the axis of the developing roller or extending in a direction inclined relative to the roller axis, and a binder for binding the carbon fibers.

20 Claims, 4 Drawing Sheets

DEVELOPING APPARATUS HAVING DEVELOPER CARRYING ROLLER WITH CARBON FIBERS IN SURFACE LAYER

FIELD OF THE INVENTION AND RELATED ART

The present invention relates to a developing apparatus for developing an electrostatic latent image. It is conventional that a solid or hollow roller is used for carrying a developer into a developing zone. Where a dry type one component developer which does not contain carrier particles is used, a ghost image is sometimes produced in a developed image, and/or an image density sometimes decreases gradually during continuous operation. These phenomena are remarkable in a developing apparatus using toner which is triboelectrically charged to a negative polarity than in a developing apparatus using toner positively chargeable. The reason is as follows. The above phenomena are related to the amount of triboelectric charge of the toner, and the toner particles containing as a major component synthetic resin are easily charged to the negative polarity by friction, and therefore, the amount of charge is relatively large when it is charged to the negative polarity. When silica particles which are triboelectrically charged to the negative polarity are added to the one component developer as an agent for controlling the amount of triboelectric charge for the toner which is triboelectrically charged to the negative polarity, the image density is improved, and the image roughness is decreased. On the contrary, however, the above phenomena become more remarkable. The ghost image will be further described. A ghost image is first formed on the toner layer on the developing sleeve in the form of a pattern having been printed. This ghost image appears on the next printed image.

Referring to FIG. 1, the density difference occurs between (a) portion where non-printing (white background) has continued, and therefore, only a thin image appears even when the printing is effected thereafter, and a portion (b) where the printing has been continued, and therefore, a thick image appears. If the reflection density difference between the (a) portion and the (b) portion ($\Delta G$) is not less than 0.1D, the density difference is quite conspicuous.

The mechanism of the ghost image formation has a lot to do with a fine particle (particle size of not more than 5–6 microns) layer formed on the sleeve. That is, a significant difference is produced in the particle size distribution in the bottom-most toner layer on the developing sleeve between the toner consumed portion and the non-consumed portion, and the fine particle layer is formed in the bottom-most surface of the toner where the toner is not consumed. The fine particles have relatively large surface area per unit time, and therefore, the amount of triboelectric charge per unit weight is larger than that of large size particles, and therefore, they are strongly confined on the sleeve by the electrostatic force. This prevents the toner on the fine particle layer from sufficient friction with the developing sleeve, with the result of lowered developing power. This leads to the production of the sleeve ghost. From the above analysis, it results that in order to reduce the sleeve ghost, the electric charge of the charged-up particles adjacent to the developing sleeve may be leaked to the sleeve. However, the aluminum sleeve which is used frequently has an aluminum oxide film on the surface of the sleeve so that no ohmic electric conduction is formed, and therefore, the electric charge of the fine particles are not sufficiently leaked.

U.S. Ser. No. 341,352 proposes a developing roller having a surface layer wherein carbon particles or the graphite particles are bound by resin material. In this proposal, the sleeve ghost is reduced by using a sleeve having a surface resin layer containing electrically conductive particles which are projected out and having a volume resistivity of $10^2$–$10^{-3}$ ohm.cm. For example, the good results are obtained when the surface layer of the sleeve are made of the following:

Conductive fine particles: graphite (7 microns) 15 parts by weight
Resin: phenol resin (solid) 15 parts by weight
Diluent: methyl alcohol
methyl cellosolve 225 parts by weight The layer is formed by dipping method or spray method into a film thickness of approximately 4 microns on the aluminum sleeve. Since the phenol resin is heat-curable, it is cured in a dry oven at approximately 150° C. for about 30 minutes. The volume resistivity of the film is 7.0–$10^{-1}$ ohm.cm.

When this sleeve is used, the ghost image is decreased, and the image density is increased even under low temperature and low humidity conditions such as 15° C. and 10% of relative humidity.

However, the sleeve has a drawback that the resistance to wear is not very good with the result of a short service life which requires frequent exchange of the sleeve.

Under high temperature and high humidity condition such as 35° C. and 80% of relative humidity, there is a tendency that the triboelectric charge amount of toner is not sufficient with the result of insufficient image density. Particularly, after the apparatus is left for a relatively long period, the image density decrease is significant. In order to prevent this, it is effective to employ an elastic blade press-contacted to the sleeve to form the toner layer. The material of the elastic blade is a rubber elastic material such as urethane rubber, a metal elastic material such as stainless steel and resin elastomer such as polyethylene terephthalate.

In the developing apparatus wherein the elastic blade is contacted to the sleeve, the toner is strongly frictioned with the sleeve so that the triboelectric charge application to the toner is great, and therefore, the sufficient image density can be provided even under the high temperature and high humidity condition. If the elastic blade is used with the sleeve coated with the conductive resin, the fine particles are prevented from being charged up, and the developed image is with reduced sleeve ghost. Therefore, good quality of the images can be provided, but the durability of the sleeve coated with the resin material containing the conductive fine particles is not satisfactory. More particularly, in a large scale and high speed image forming apparatus wherein the sleeve is exchanged after approximately hundred thousand sheets are copied, the resin layer of the surface of the sleeve is removed by the function of the elastic blade with the result of non-uniform image density in an image, and the sleeve ghost is produced.

Japanese Laid-Open Patent Application No. 23171/1986 discloses a developing roller having a surface layer of a resin material containing carbon fibers to enhance the durability of the developing roller. However, where the short fibers are dispersed in the resin of the surface layer, the electric properties of the developing roller becomes non-uniform. When, for example, a developing bias is applied to the roller, the potential of the roller surface is not uniform, with the result that a very high image quality can not be provided.

SUMMARY OF THE INVENTION

Accordingly, it is a principal object of the present invention to provide a developing apparatus wherein the ghost image is suppressed.

It is another object of the present invention to provide a developing apparatus wherein the image density reduction can be suppressed.

It is a further object of the present invention to provide a developing apparatus having a high durability wherein the ghost image and the image density decrease are suppressed.

It is a further object of the present invention to provide a developing apparatus which is capable of providing a high quality developed image, wherein the ghost image and the image density decrease can be suppressed.

These and other objects, features and advantages of the present invention will become more apparent upon a consideration of the following description of the preferred embodiments of the present invention taken in conjunction with the accompanying drawings.

The invention includes a developing apparatus for developing an electrostatic latent image formed on an image-bearing member in a developing zone. The developing apparatus includes a developer carrying roller for carrying a developer to the developing zone. The developer carrying roller has a surface layer containing carbon fibers extended substantially parallel to an axis of the developer carrying roller and a binder binding the carbon fibers.

DESCRIPTION OF THE PREFERRED EMBODIMENTS

Figure 2:
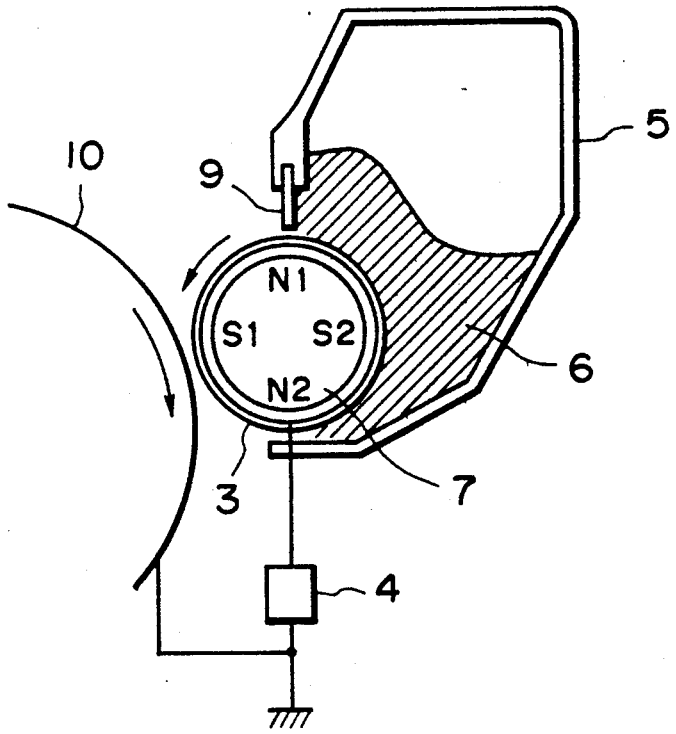
FIGS. 2, 3 and 4 are sectional views of developing apparatuses to which the present invention is applicable.

Referring to FIG. 2, there is shown a developing apparatus to which the present invention is applicable. A sleeve 3 is rotatable in the direction indicated by an arrow and functions to carry the developer supplied thereto in a container 5 to a developing zone. The developer is a one component developer containing negatively chargeable magnetic toner. The developer also contains silica fine particles as a charge controlling agent. The silica fine particles are also chargeable to the negative polarity. The thickness of the developer layer is regulated by a blade 9 which is disposed adjacent the sleeve 3 with a small clearance. If the blade 9 is of magnetic material such as iron and is disposed within the influence of the magnetic field provided by the magnet 7 fixed in the sleeve 3, the formed developer layer has a thickness smaller than the clearance between the blade 9 and the sleeve 3. In the apparatus of FIG. 2, the minimum clearance between the sleeve 3 and an electrophotographic photosensitive member (image bearing member) 10 is larger than the thickness of the developer layer, in the developing zone. The sleeve 3 is supplied with a bias voltage provided by superimposing a DC voltage and an AC voltage, by a bias voltage source 4, by which an vibratory electric field is formed in the developing zone. By the vibrating electric field, the toner reciprocates in the developing zone, and they are deposited to an image portion of the latent image to visualize it.

The bias voltage applied to the developing apparatus used in this embodiment had the frequency f of 1800 Hz and a peak-to-peak voltage Vpp of 1600 V, which was provided by combining an AC voltage and a DC voltage Vdc of −500 V. The minimum clearance between the sleeve and the photosensitive member was 300 microns, but it may be lower. The photosensitive member surface potential of the latent image was −700 V at a portion where it is not exposed to light (dark potential) and −100 V at the portion where it is exposed to light (light potential). In this apparatus, the development is a so-called reversal development wherein the toner particles are deposited to the light potential portion.

The volume resistivity of the toner is $10^{10}$–$10^{12}$ ohm.cm. As an example, a negatively chargeable magnetic toner contains styrene acryl resin containing 60% by weight of magnetite. The fine silica particles added to the toner is, for example, dry negative silica particles having strong negative chargeable property. This can be produced by mixing 100 parts by weight of 100 $m^2/g$ silica produced by a vapor phase method and 10 parts by weight of HMDS, and by heating the mixture. The toner particles and the silica particles are charged triboelectrically by friction with the sleeve to a polarity for developing the latent image.

Figure 3:
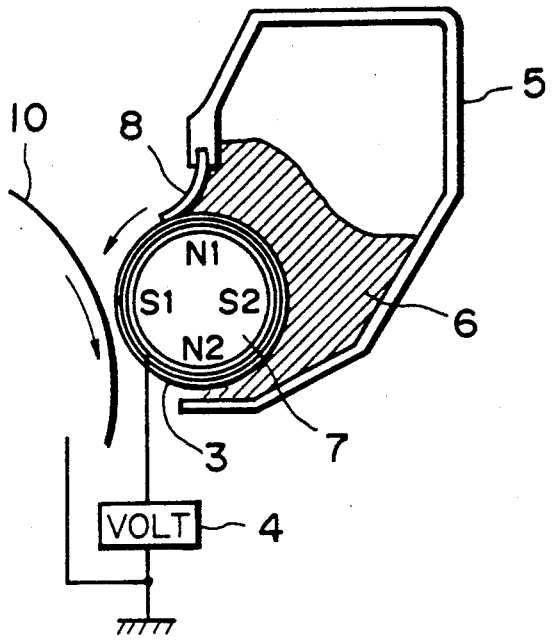

In the apparatus of FIG. 3, an elastic blade 8 is press-contacted to the sleeve 3 to regulate the thickness of the developer layer to be formed on the sleeve 3. In addition, the developer is rubbed with the sleeve by strong force to increase the amount of charge of the developer. In the other respects, the apparatus is similar to that shown in FIG. 2. The blade 8 is press-contacted to the sleeve 3 by force of 30 g/1 cm in the longitudinal direction of the sleeve. The material of the blade 8 is for example urethane rubber blade having a thickness of 1 mm. Other examples of the blade 8 material are a material having a rubber elasticity such as silicone rubber, a metal such as stainless steel or phosphor bronze and high polymer resin such as polyethylene terephthalate or tetrafluoroethylene resin. The pressure of the pressure contact between the blade 8 and the sleeve 3 is properly selected by one ordinary skilled in the art within the range of 10–100 g/1 cm of a length in the longitudinal direction of the sleeve. Experiments have been carried out with sleeve surfaces treated to different surface roughnesses, and it has been found that good toner layer is formed on the sleeve, and good images can be produced when the roughness Rz (ten point average roughness defined in the Japanese Industrial Standard) is 1–20 microns, further preferably 3–10 microns.

Figure 4:
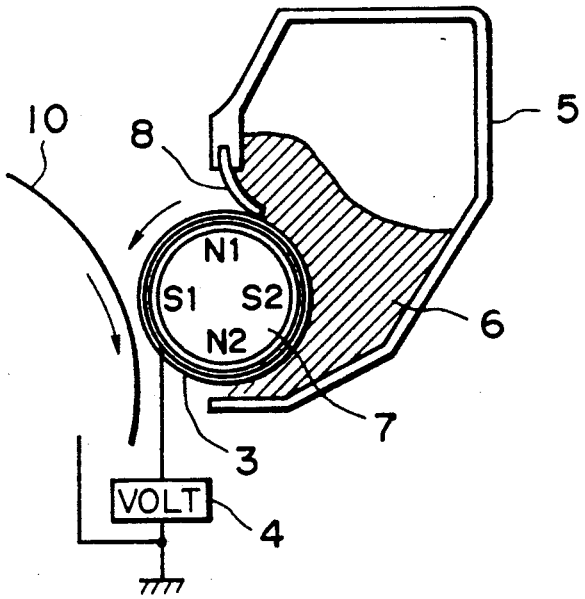

In the FIG. 3 apparatus, the free end of the blade 8 is press-contacted to the sleeve 3 at a position downstream of a fixed end where the blade 8 is fixed to the container 5 with respect to the rotational direction of the sleeve. It may be upstream as shown in FIG. 4.

The sleeve 3 is constituted by long carbon fibers having a length not less than 5 cm bound by binding material.

Figure 5:
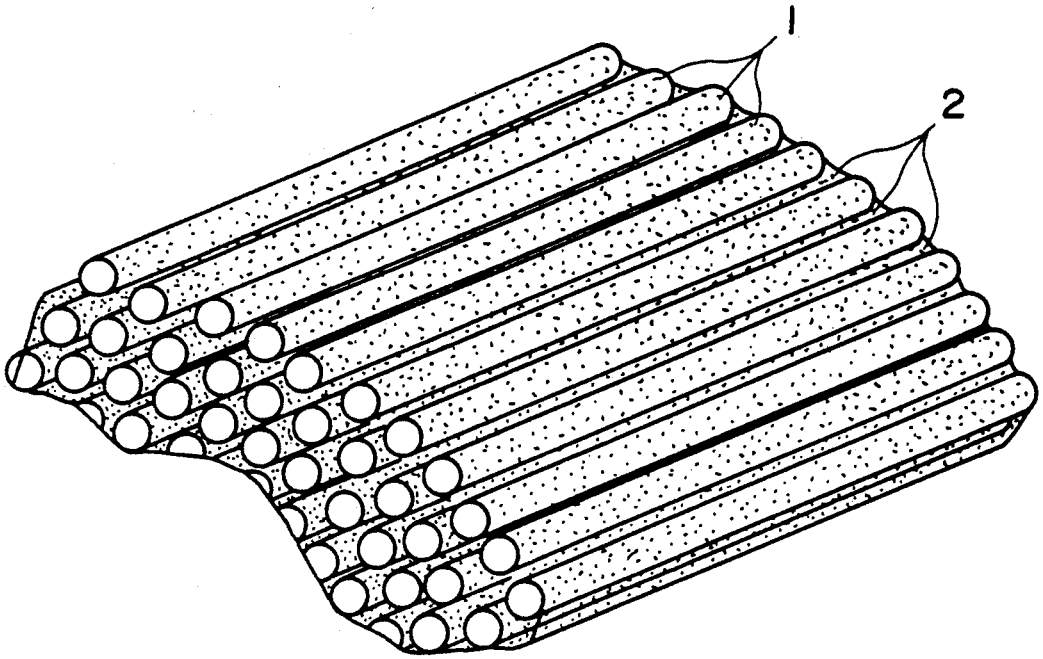
FIG. 5 is an enlarged perspective view of a part of a surface of a developing roller according to an embodiment of the present invention.

Referring to FIG. 5, there is shown an enlarged perspective view of a part of a surface layer portion of the sleeve used with the apparatus of FIG. 2.

The carbon fibers extend, in this embodiment, substantially parallel with the longitudinal direction of the sleeve, and the fibers are bound by a high polymer resin binder 2. An example of the carbon fibers is PILOFILL available from Mitsubishi Rayon Kabushiki Kaisha, which is polyacrylonitrile carbon fibers. The diameter of the carbon fibers is approximately 7 microns, and an example of the binder is ABS resin. The specific volume resistivity of the carbon fiber itself is not more than $10^2$ ohm.cm, particularly between $1\times10^{-3}$–$2\times10^{-3}$ ohm.cm. By changing the contents of the carbon fibers and the binder resin, the volume resistivity of the sleeve can be changed. The carbon fiber content in this embodiment is 30–40% by weight, and the volume resistivity of the carbon fiber containing resin layer is approximately $10^0$–$10^1$ ohm.

The carbon fibers are relatively long (not less than 5 cm). The developing sleeve is in the form of a cylinder. In this embodiment, it is produced by wrapping a circular column having a diameter of 14 mm with a high polymer resin sheet having a thickness of 1 mm and containing the carbon fibers. During this production, the directions of the carbon fibers are controlled. The sleeve produced in this manner has an inside diameter of approximately 14 mm and an outside diameter of approximately 16 mm. Then, it is completely cured into a usable developing sleeve. If necessary, it is machined. Other examples of high polymer resin binder are polyethylene, polyacryl, polyester, polycarbonate, polybutyreneterephthalate, PPS, polyacetal, nylon 66 or other synthetic resin materials.

A developing sleeve of a resin material containing carbon black is known. However, the conventional resin sleeve has a tendency that the bending strength extremely reduces with the reduction of the volume resistivity. However, the sleeve of the resin containing the carbon fibers have strength which is approximately double or triple of the conventional ones. This is particularly effective when the size of the sleeve is small as in this embodiment. The good mechanical properties are shown in the following Table in terms of the bending strength and the bending elasticity.

TABLE 1

| resin - fiber content | Bending Strength ($kg/cm^2$) | Bending Elasticity ($kg/cm^2$) |
|---|---|---|
| pps - 0% | approx. 1200 | approx. $0.5\times10^5$ |
| pps - 30% | approx. 2300 | approx. $1.5\times10^5$ |
| nylon 66 - 0% | approx. 1000 | approx. $0.3\times10^5$ |
| nylon 66 - 30% | approx. 3000 | approx. $1.5\times10^5$ |

As will be understood from the foregoing, by containing the carbon fibers, the sleeve having the low resistivity and a high strength can be produced.

An example of the diameter of the carbon fibers is 7 microns in this embodiment, but by changing the diameter, it is possible to provide sleeves having different surface roughness. The length of the carbon fibers is not limited to 5 cm, but it may be as long as the length of the sleeve. The long carbon fibers are electrically connected with each other at various positions, whereby the electric resistance of the sleeve is low, and since the carbon fibers are relatively long, the voltage drop along the direction of the axis of the sleeve when the bias voltage is applied can be practically neglected.

As described hereinbefore, the ghost image is attributable to the charge-up of the fine toner particles on the sleeve surface. In this embodiment, the sleeve is not easily oxidized, and it has a low volume resistivity. Since it contains carbon fibers which are partly graphite providing solid lubricity. For those reasons, the electrostatic attraction force is reduced, and in addition, the deposition thereto of the matter contaminating the sleeve such as the toner fine particles and the toner controlling agent in the toner is physically prevented.

Table 2 shows results of experiments wherein the developing sleeve according to this embodiment is incorporated into the developing apparatus shown in FIG. 2, and the developing apparatus is incorporated in a laser beam printer wherein latent images are reverse-developed, particularly under low temperature and low humidity condition. The toner used had the volume resistivity of $10^{10}$–$10^{12}$ ohm/cm.

TABLE 2

| Fiber content | volume resistivity | Sleeve ghost | Image density change (10000 sheets) |
|---|---|---|---|
| 30% | $10^1$–$10^2$ cm | G | G |
| 40% | $10^{10}$ ohm · cm | G | G |
| Al sleeve | — | NG | NG |

G: good
NG: no good

Figure 1:
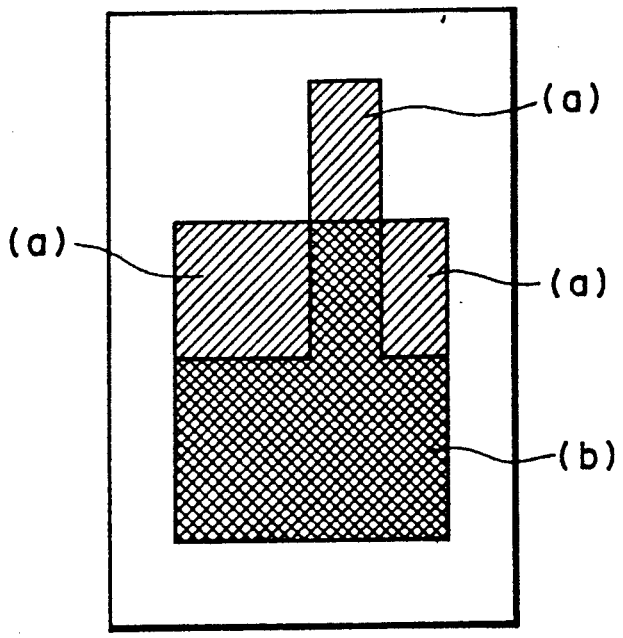
FIG. 1 illustrates a ghost image.

As regard the sleeve ghost, the mark "NG" (no good) is given when the density difference between (b) and (a) as described with FIG. 1 is not less than 0.1, or when the boundary between the (b) portion and (a) portion is clear.

Figure 6:
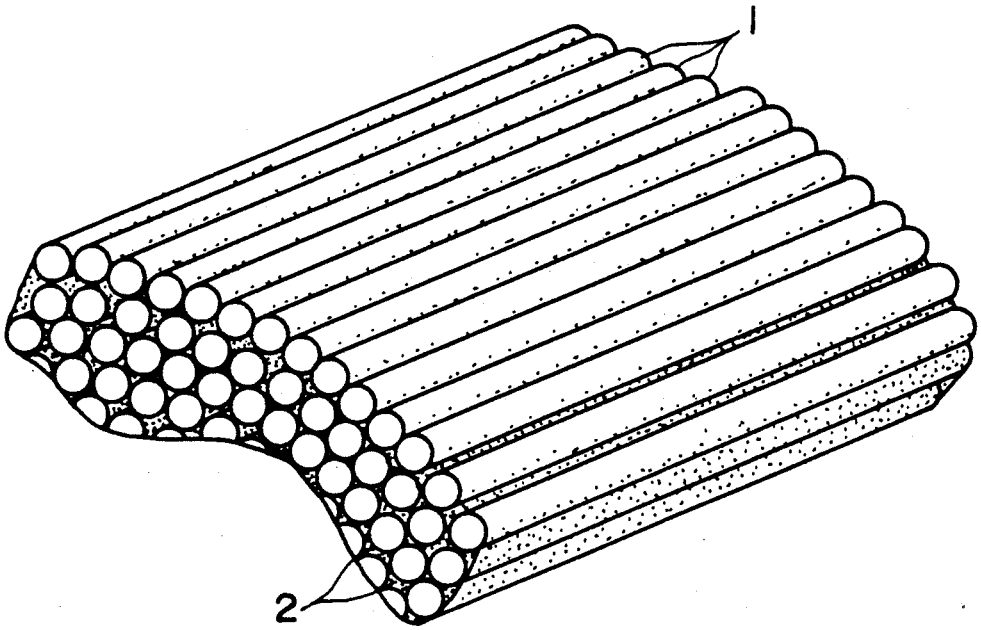
FIG. 6 is an enlarged perspective view of a part of a surface of a roller according to another embodiment of the present invention.

In an example of FIG. 6, at least a portion of the carbon fibers is exposed at the roller surface. In this embodiment, the carbon fibers extend parallel to the axis of the sleeve.

In this embodiment, the carbon fiber content is 50–90% by weight on the basis of the resin, and the volume resistivity of the resin layer containing the carbon fibers is not more than $10^0$ ohm.cm approximately.

In this embodiment, since the carbon fibers are uniformly exposed along the entire sleeve periphery, the excessive charge of the developer can be removed with certainty.

The results of experiments using the developing device with the sleeve having the layer shown in FIG. 6, in the similar manner, are shown in Table 3.

TABLE 3

| Fiber content | volume resistivity | Sleeve ghost | Image density change (10000 sheets) |
|---|---|---|---|
| 50–70% | $10^0$ ohm · cm~ | Excellent | Excellent |
| 70–90% | $\leqq 10^0$ ohm · cm | Excellent | Excellent |
| Al sleeve | — | No Good | No Good |

In this embodiment, the volume resistivity of the carbon fibers may be higher than $2$—$10^{-3}$ ohm.cm, but it is not preferable because the mechanical strength is not enough when the carbon fiber content is too large.

With the increase of the carbon fiber content, the suppressing power of the ghost image or the like is improved. However, there is a tendency that when the close contactness between the carbon fibers and the resin is not good, the carbon fibers are easily separated. In an actual developing apparatus, the problem arising from this can be avoided by reducing the torque.

FIG. 5 shows another example of avoiding this, wherein the carbon fibers 1 are woven in the resin binder 2, so that the strength is improved.

Figure 7:
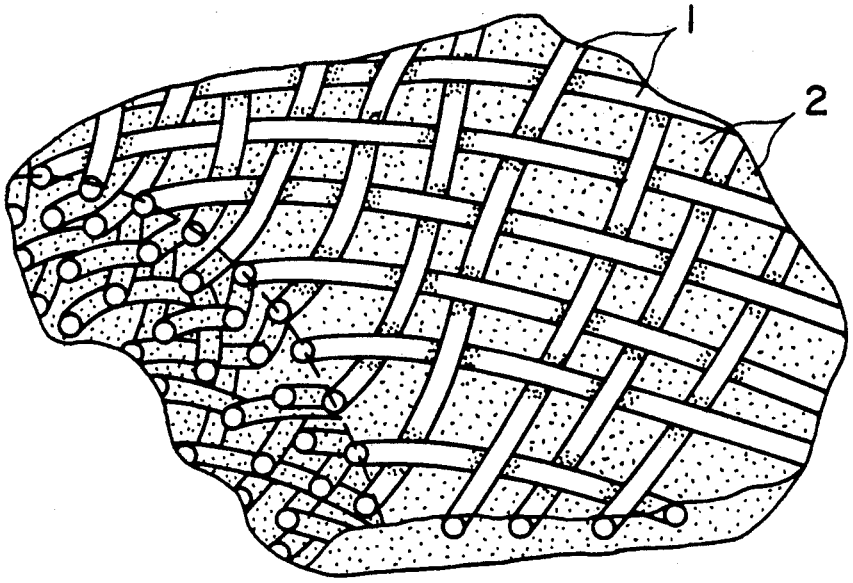
FIG. 7 is an enlarged perspective view of a surface of a roller according to a further embodiment of the present invention.

In FIG. 7, the carbon fibers 1 are inclined relative to the axis of the sleeve, and the carbon fibers 1 are crossed and alternately woven, and therefore, the carbon fibers are not easily separated from the binder even if the sleeve is subjected to the torque in the sleeve rotation direction. In the example of FIG. 7, the carbon fibers are electrically connected, and therefore, the electric resistance of this layer is substantially uniform. It is preferable that a part of the carbon fibers is exposed at the surface.

By selecting the carbon fiber content, the volume resistivity can be changed in a quite large range. Therefore, by proper selection thereof, various image density can be provided. It is known that by changing the volume resistivity of the developing sleeve, the lines of electric force per unit area resulting from the electric field between the developing sleeve and the latent image potential of the image bearing member having the latent image can be changed. However, in the conventional resin sleeve, when the volume resistivity of the resin sleeve is high, the voltage drop occurs not only in the radial direction of the developing sleeve, but in the axial direction thereof, and therefore, when a voltage is applied at one longitudinal end of the developing sleeve using a metal electrode, the output image has differences in the image density and the line width between the opposite longitudinal ends of the sleeve. In the present invention, the carbon fibers contained in the resin sleeve have low volume resistivity and are long along the longitudinal direction of the sleeve, by which the volume resistivity in the normal direction is increased, but the voltage drop in the direction of the axis can be reduced to a practically negligible extent. Therefore, the thickness of the developing sleeve can be reduced, and a small diameter developing sleeve can be used. Therefore, it is usable in a small size image forming apparatus.

Figure 8:
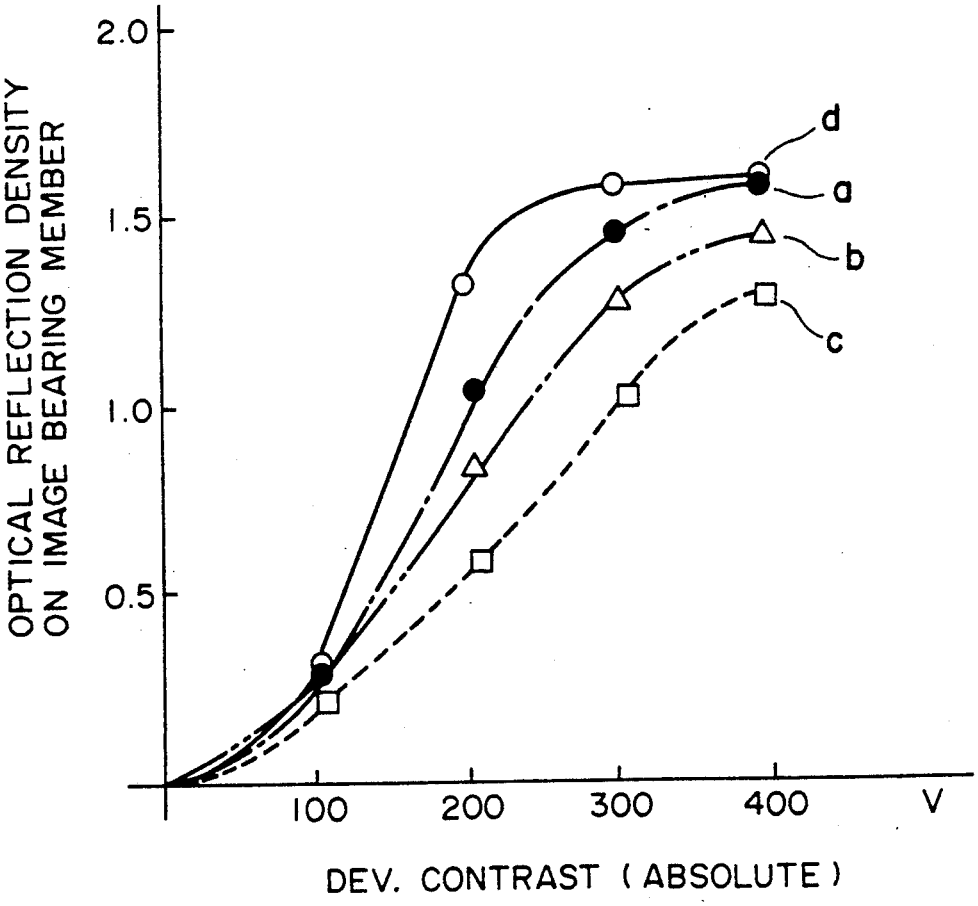
FIG. 8 is a graph of an image density of various developing rollers.

FIG. 8 shows optical reflection density on the image bearing member relative to various carbon fiber contents (which will hereinafter be called "α-curve". The data are when the experiments are carried out using the developing apparatus of FIG. 2 and a commercially available laser beam printer of a reverse development type. The binder used was polycarbonate, and the toner used was negatively chargeable one component magnetic developer. The carbon fibers had volume resistivity of $10^{-3}$–$10^{2}$ ohm.cm.

TABLE 4

| Fiber content | Volume resistivity | Reference character in FIG. 8 |
|---|---|---|
| approx. 20% | approx. $10^3$ ohm · cm | a |
| approx. 10% | approx. $10^6$ ohm · cm | b |
| 5% | approx. $10^{12}$ ohm · cm | c |
| Al sleeve | — | d |

As will be understood from FIG. 8, the α-curve changes in proportion to the carbon fiber content.

In FIG. 8, the horizontal axis represents an absolute value of a difference between a DC component of the developing bias voltage and the light potential of the latent image (the potential of the portion receiving the toner).

The sleeve having the layer shown in FIG. 7 can be used with the apparatus of FIG. 3 or FIG. 4. For example, long fibers 1 which may be PILOFILL, available from Mitsubishi Rayon Kabushiki Kaisha, Japan, having a diameter of 5 microns are crossed with each other and laminated, and are bound by polycarbonate into a sheet having a thickness of 1.0 mm. This is formed into a cylinder by wrapping around a column having a diameter of 14.0 mm. The carbon fiber content is 40% by weight, and the volume resistivity of the sleeve is $10^0$ ohm.cm. The surface roughness of the sleeve Rz is 4.0 microns (ten point average roughness (Japanese Industrial Standard)).

The sleeve having the layer shown in FIG. 5 or 6 may be applied to the apparatus shown in FIG. 3 or 4.

In the above embodiments, the carbon fiber content is not less than 20% by weight and not more than 90% by weight. If it is smaller than 20% by weight, the ghost image and the image density reduction more easily occur. If it is larger than 90% by weight, on the contrary, the strength becomes insufficient. From the standpoint of suppressing the ghost image and the image density reduction, the volume resistivity of the carbon fiber containing resin layer is not less than $10^{-3}$ ohm.cm and not more than $10^4$ ohm.cm.

In the embodiments, the carbon fibers are regularly arranged. Therefore, the surface roughness of the sleeve is uniform over the entire surface thereof, and the production thereof can be stabilized. In addition, the amount of the toner applied on the sleeve is uniform and stable. Therefore, the image density can be stabilized, and the image quality can be improved. This is significant from the standpoint of avoiding blotches produced in low temperature and low humidity condition, for example. The "blotch" is image density non-uniformity attributable to the non-uniform toner layer thickness.

In the sleeve of the present invention, the sleeve material itself has high strength and high durability to wear, but even if the surface is worn by the use for 100,000 sheets image productions, substantially the same carbon fiber surface appears because the structure of the sleeve is substantially the same at any portion in the thickness thereof. Therefore, the image quality is not deteriorated by the use.

The sleeve or a solid roller may be constructed only by the carbon fiber containing resin material, or a core member made of metal or the like may be coated with the carbon fiber containing resin layer. When the core member is of metal, the core metal may be contacted to an electrode for applying the developing bias voltage. When the sleeve is constructed by the carbon fiber containing resin only, the electrode for the application of the bias voltage can be contacted to a longitudinal end surface or to a small area of the inside surface of the sleeve. Alternatively, the electrode for the bias voltage application is constructed by a long conductive rubber blade or brush, by which the voltage is applied over the entire length of the sleeve at the inside surface of the sleeve. Further alternatively, the inside surface of the sleeve may be coated with conductive paint to maintain the electric conductivity or coated with metal liner, wherein the electrode is contacted to the conductive material. In the case of solid roller of carbon fiber containing resin, the electrode may be contacted to a side surface or the like.

In the foregoing embodiments, the charge controlling agent added to the toner is fine particles of dry silica produced by vapor phase method, but silica fine particles produced by wet method may be added. The present invention is applicable to a developing device of a regular development type wherein the developer is deposited to the dark potential portion of the latent image. In the embodiments described hereinbefore, the developing method is of a non-contact type. However, the present invention is applicable to a contact type developing method wherein the developing layer conveyed to the developing zone has a thickness larger than the minimum clearance between the photosensitive member and the developing roller. The present invention is also applicable to a developing apparatus wherein only a DC bias voltage without the AC component is applied to the developing roller thereof. It is also applicable to a developing apparatus using a developer containing one component non-magnetic developer, that is, non-magnetic toner added by charge controlling agent or the like. Furthermore, the present invention is applicable to a developing apparatus using a toner which is triboelectrically charged to the positive polarity.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image formed on an image bearing member in a developing zone, comprising:

a developer carrying roller for carrying a developer to the developing zone, said roller comprising:

a surface layer containing carbon fibers extended substantially parallel to an axis of said developer carrying roller and a binder binding the carbon fibers.

2. An apparatus according to claim 1, wherein a part of the carbon fibers are exposed at a surface of said roller.

3. An apparatus according to claim 1 or 2, further comprising means for applying a bias voltage to said roller.

4. An apparatus according to claim 3, wherein said surface layer contains 20–90% by weight of carbon fibers.

5. An apparatus according to claim 3, wherein said surface layer has a volume resistivity of $10^{-3}$–$10^{4}$ ohm.cm.

6. An apparatus according to claim 3, further comprising developing layer regulating means for regulating a thickness of a layer of the developer formed on the roller to be smaller than a minimum clearance between the roller and the image bearing member in the developing zone.

7. An apparatus according to claim 6, wherein said regulating means includes an elastic blade contacted to said roller.

8. An apparatus according to claim 6, wherein the developer is a one component developer containing toner particles negatively chargeable by friction with said roller and fine silica particles negatively chargeable by friction with said roller.

9. An apparatus according to claim 6, wherein the bias voltage applied to said roller is a vibratory voltage.

10. An apparatus according to claim 6, wherein the bias voltage applied to said roller is a DC voltage.

11. A developing apparatus for developing an electrostatic latent image formed on an image bearing member in a developing zone, comprising:

a developer carrying roller for carrying a developer to the developing zone, said roller comprising:

a surface layer containing long carbon fibers extended in a direction inclined relative to an axis of said roller and a binder binding the carbon fibers.

12. An apparatus according to claim 11, wherein a part of the carbon fibers are exposed at a surface of said roller.

13. An apparatus according to claim 11 or 12, further comprising means for applying a bias voltage to said roller.

14. An apparatus according to claim 13, wherein said surface layer contains 20–90% by weight of carbon fibers.

15. An apparatus according to claim 13, wherein said surface layer has a volume resistivity of $10^{-3}$–$10^{4}$ ohm.cm.

16. An apparatus according to claim 13, further comprising developing layer regulating means for regulating a thickness of a layer of the developer formed on the roller to be smaller than a minimum clearance between the roller and the image bearing member in the developing zone.

17. An apparatus according to claim 16, wherein said regulating means includes an elastic blade contacted to said roller.

18. An apparatus according to claim 16, wherein the developer is a one component developer containing toner particles negatively chargeable by friction with said roller and fine silica particles negatively chargeable by friction with said roller.

19. An apparatus according to claim 16, wherein the bias voltage applied to said roller is a vibratory voltage.

20. An apparatus according to claim 16, wherein the bias voltage applied to said roller is a DC

* * * * *

UNITED STATES PATENT AND TRADEMARK OFFICE

CERTIFICATE OF CORRECTION

PATENT NO. : 5,027,745

DATED : July 2, 1991

INVENTOR(S) : MICHIHITO YAMAZAKI, ET AL.

It is certified that error appears in the above-identified patent and that said Letters Patent is hereby corrected as shown below:

ON THE TITLE PAGE:

IN [56] REFERENCES CITED

U.S. PATENT DOCUMENTS, "4,037,709 7/1977 Fraser" should read --4,034,709 7/1977 Fraser--.

IN [57] ABSTRACT

Line 2, "an" should read --a--.

COLUMN 1

Line 51, "bottom-most" should read --bottommost--.
Line 54, "bottom-most" should read --bottommost--.

COLUMN 4

Line 12, "an" should read --a--.
Line 59, "ordinary" should read --ordinarily--.

COLUMN 6

Line 11, "resistivity." should read --resistivity,--.
Line 12, "Since" should read --since--.
Line 36, "regard" should read --regards--.
Line 66, "$2-10^{-3}$" should read --$2 \times 10^{-3}$--.

COLUMN 7

Line 4, "contactness" should read --contact--.
Line 50, ""α-curve"." should read --"α-curve").--.

--

UNITED STATES PATENT AND TRADEMARK OFFICE

CERTIFICATE OF CORRECTION

PATENT NO. : 5,027,745

DATED : July 2, 1991

INVENTOR(S) : MICHIHITO YAMAZAKI, ET AL.

It is certified that error appears in the above-identified patent and that said Letters Patent is hereby corrected as shown below:

COLUMN 10

Line 55, "DC" should read --DC voltage--.

Signed and Sealed this

Ninth Day of February, 1993

*Attest:*

STEPHEN G. KUNIN

*Attesting Officer*

*Acting Commissioner of Patents and Trademarks*